US006404320B1

(12) United States Patent
Yeh et al.

(10) Patent No.: US 6,404,320 B1
(45) Date of Patent: Jun. 11, 2002

(54) METHOD FOR ADJUSTING THE INDUCTANCE OF AN INDUCTOR

(75) Inventors: Ming Yeh, Banchiau; Allen Chou, Shinjuang; Chen-Feng Wu, Bade; Chien-Chia Lin, Taoyuan, all of (TW)

(73) Assignee: Delta Electronics Inc., Taoyuan Sien (TW)

( * ) Notice: Subject to any disclaimer, the term of this patent is extended or adjusted under 35 U.S.C. 154(b) by 0 days.

(21) Appl. No.: 09/774,306

(22) Filed: Jan. 30, 2001

(30) Foreign Application Priority Data

Aug. 18, 2000 (TW) ..... 89116687 A

(51) Int. Cl.[7] ..... H01F 5/00

(52) U.S. Cl. ..... 336/200; 336/132; 336/146; 336/232; 336/198

(58) Field of Search ..... 336/198, 200, 336/223, 232, 130–132, 134, 133, 146, 149

(56) References Cited

U.S. PATENT DOCUMENTS 4,760,366 A * 7/1988 Mitsui ..... 336/233
5,760,670 A * 6/1998 Yeh et al. ..... 336/134
6,294,975 B1 * 9/2001 Chen ..... 336/198

* cited by examiner

*Primary Examiner*—Anh Mai
(74) *Attorney, Agent, or Firm*—Darby & Darby

(57) ABSTRACT

Disclosed is a method for adjusting the inductance of an inductor at least including a bobbin, a first magnetic member having a concavity on a side wall thereof, and a second magnetic member having a protrusion at a first end thereof for preventing the second magnetic member from being completely inserted into the bobbin so as to form a gap between the first and second magnetic members. The method includes the steps of selecting a reference piece with a suitable thickness to be disposed between the protrusion of the second magnetic member and the side wall of the first magnetic member with the concavity and closely attached to both of them t as said second magnetic member is inserted into said bobbin, and partially removing the second magnetic member from a second end thereof according to the thickness of the reference piece so as to obtain a predetermined inductance value. This method further includes a step of determining whether the inductance of the inductor is identical to the predetermined inductance value after the reference piece is disposed between the protrusion of the second magnetic member and the side wall of the first magnetic member with the concavity and the second magnetic member is partially inserted into the bobbin. If the inductance of the inductor is not identical to the predetermined inductance value the thickness of the reference piece can be changed to repeat the above-described steps until the predetermined inductance value is obtained.

18 Claims, 5 Drawing Sheets

METHOD FOR ADJUSTING THE INDUCTANCE OF AN INDUCTOR

FIELD OF THE INVENTION

The present invention is related to a method for adjusting the inductance of an inductor, and especially to a method for adjusting the inductance of an inductor without needing a gap spacer.

BACKGROUND OF THE INVENTION

As shown in FIGS. 1*a* and 1*b*, a conventional inductor 10 includes a bobbin 20, a U-shaped magnetic core member 30, an I-shaped magnetic core member 50, and a spacer 60. Several rounds of wires are wound on the bobbin 20 to be employed as a coil of the inductor 10. Because the magnetic core of the inductor 10 is constituted by the U-shaped magnetic core member 30 and the I-shaped magnetic core member 50, this inductor 10 is commonly called a "UI inductor". The U-shaped magnetic core member 30 has a concavity 35 on a side wall thereof. The U-shaped magnetic core member 30 is engaged with the bobbin 20 but the opening of the central hole of the bobbin 20 is exposed out of the concavity 35 of the U-shaped magnetic core member 30. The spacer 60 is disposed between the adjacent magnetic core members 30, 50 to space the core members out of contact with each other, thereby reducing magnetic interference therebetween. The spacer 60 may be made of a non-magnetic material, such as plastic, aluminum or paint, which does not cause any magnetic interference between the two magnetic core members 30, 50 and the two magnetic core members 30, 50 may be fixed and held through the spacer 60 with a certain space therebetween. Typically, this spacer 60 is made of an insulating material and adhered to one end of the I-shaped magnetic core member 50. The end of the I-shaped magnetic core member 50 with the spacer 60 is inserted into the central hole of the bobbin 20 through the concavity 35 for allowing the spacer 60 to be attached to the U-shaped magnetic core member 30 so as to assemble the inductor 10 as shown in FIG. 1*a*. Briefly, the function of the spacer 60 is to form a gap between the I-shaped magnetic core member 50 and the U-shaped magnetic core member 30 so that the inductance of the inductor 10 can be changed by adjusting the spacer size.

However, when manufacturing such an inductor, there exists some problems as follows.

(1) When the I-shaped magnetic core member 50 is inserted into the hole of the bobbin 20, the spacer 60 may be adhered to the inner wall of the central hole of the bobbin 20 due to its adhesive property. If the I-shaped magnetic core member 50 is forcedly inserted into the bobbin 20, the spacer 60 may be deformed, thereby influencing the thickness of the spacer 60 and generating an error of the gap, so that the predetermined inductance can not be obtained.

(2) It is uneasy to precisely control the length of the I-shaped magnetic core member 50 inserted into the bobbin 20.

(3) One end of the I-shaped magnetic core member 50 is attached to the U-shaped magnetic core member 30 only through the spacer 60. When manufacturing the inductor, the gap may become larger because of the thermal expansion of the spacer so that the inductance of the inductor may be changed.

(4) If the gap is too large or the spacer 60 is too thick, the other end of the I-shaped magnetic core member 50 will be protruded over the edge of the bobbin 20, or even over the pin 70 of the bobbin 20, after inserting the I-shaped magnetic core member 50 into the central hole of the bobbin 20.

(5) The size of the spacer 60 must be matched with that of the central hole of the bobbin 20. If the size of the spacer 60 is too big, the I-shaped magnetic core member 50 can not be smoothly inserted into the central hole of the bobbin 20. If the size of the spacer 60 is too small, the spaced area between the I-shaped magnetic core member 50 and the U-shaped magnetic core member 30 may be insufficient.

Therefore, it is desirable to develop a method for adjusting the inductance of an inductor without needing a gap spacer so as to solve the above-described defects.

SUMMARY OF THE INVENTION

An object of the present invention is to provide a method for adjusting the inductance of an inductor.

Another object of the present invention is to provide a method for adjusting the inductance of an inductor without needing a gap spacer.

The inductor at least includes a bobbin with at least one round of wire wound thereon, a first magnetic member having a concavity on a side wall thereof, and a second magnetic member having a protrusion at a first end thereof for allowing the second magnetic member to be partially inserted into the bobbin through the concavity of the first magnetic member. According to the present invention, the method includes the steps of selecting a reference piece with a suitable thickness to be disposed between the protrusion of the second magnetic member and the side wall of the first magnetic member with the concavity and closely attached to both of them as the second magnetic member is inserted into the bobbin, and partially removing the second magnetic member from a second end thereof according to the thickness of the reference piece so as to obtain a predetermined inductance value.

In addition, the method further includes a step of determining whether the inductance of the inductor is identical to the predetermined inductance value after the reference piece is disposed between the protrusion of the second magnetic member and the side wall of the first magnetic member and the second magnetic member is partially inserted into the bobbin. The thickness of the reference piece can be changed if the inductance of the inductor is not identical to the predetermined inductance value.

Preferably, the first magnetic member is a U-shaped type magnetic core member and the second magnetic member is an I-shaped type magnetic core member. The first and second magnetic members can be made of one selected from a relatively soft magnetic material, Mn—Zn ferrite, Ni—Zn ferrite and a silicon steel plate, respectively, and employed as a magnetic core of the inductor.

Preferably, the second magnetic member is shortened by polishing the second end thereof.

The reference piece is used for forming a gap between the second end of the second magnetic member and another side wall of the first magnetic member opposed to the side wall of the first magnetic member with the concavity. The height of the reference piece is greater than that of the side wall of the first magnetic member with the concavity to prevent the second magnetic member from being completely inserted into the bobbin. Certainly, the reference piece is removed before the inductor is assembled.

Preferably, the protrusion of the second magnetic member has a recess formed on an upper surface thereof for inserting a tool therein to grab the second magnetic member.

The present invention may best be understood through the following description with reference to the accompanying drawings, in which:

DETAILED DESCRIPTION OF THE PREFERRED EMBODIMENT

The present invention will now be described more detailedly with reference to the following embodiments. It is to be noted that the following descriptions of the preferred embodiments of this invention are presented herein for the purpose of illustration and description only. It is not intended to be exhaustive or to be limited to the precise form disclosed.

Figure 1A:
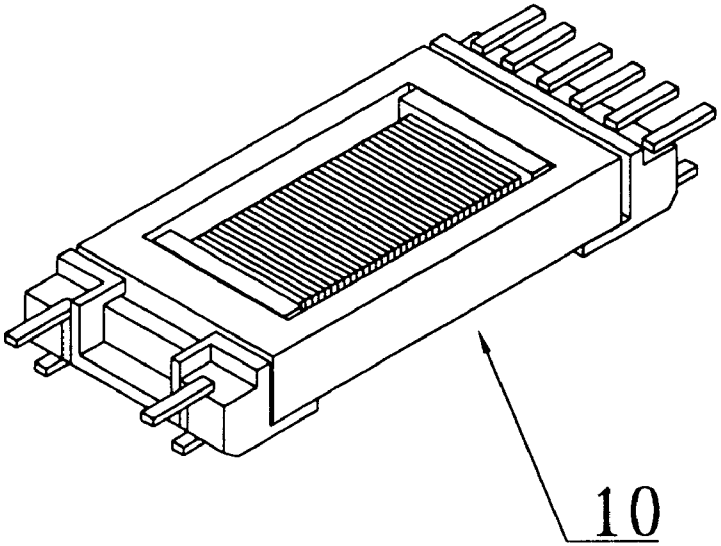
Fig.1a (Prior Art)
FIG. 1*a* is a perspective view of a conventional UI inductor.
Figure 1B:
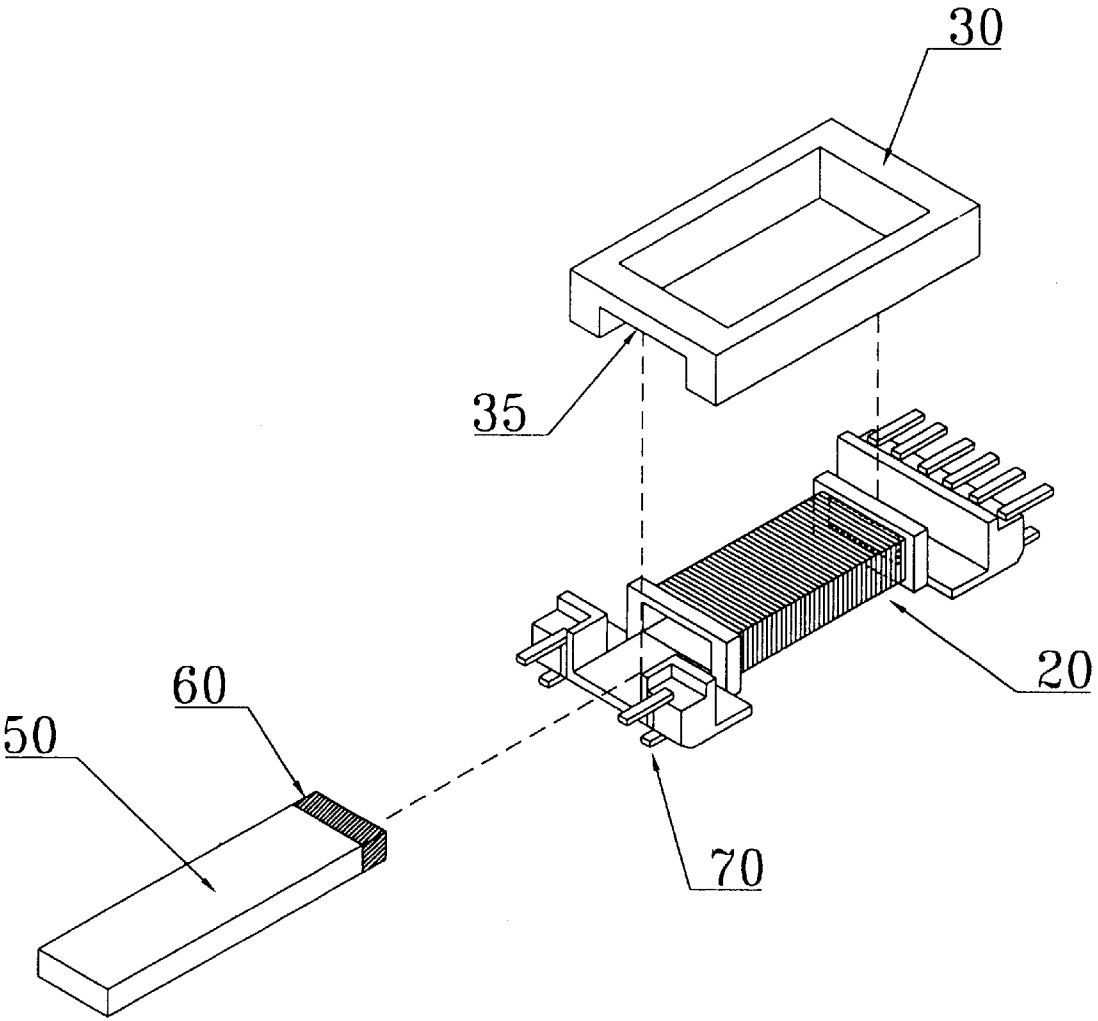
Fig.1b (Prior Art)
FIG. 1*b* is an exploded view of the conventional UI inductor shown in FIG. 1*a;*
Figure 2A:
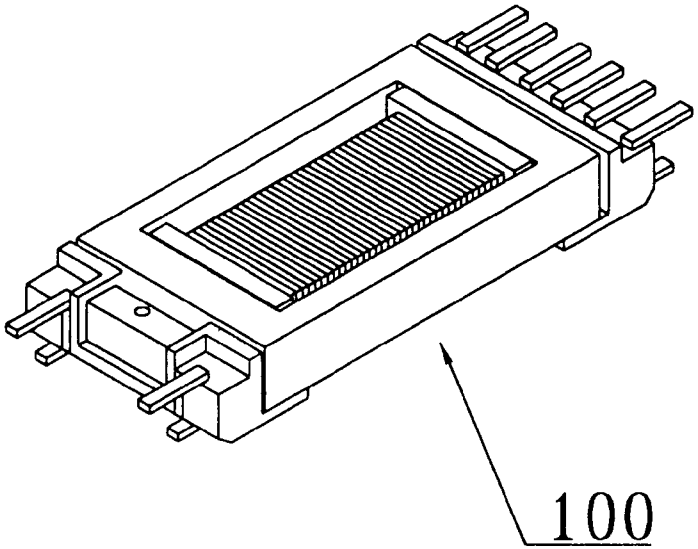
FIG. 2*a* is a perspective view of an inductor according to the present invention.
Figure 2B:
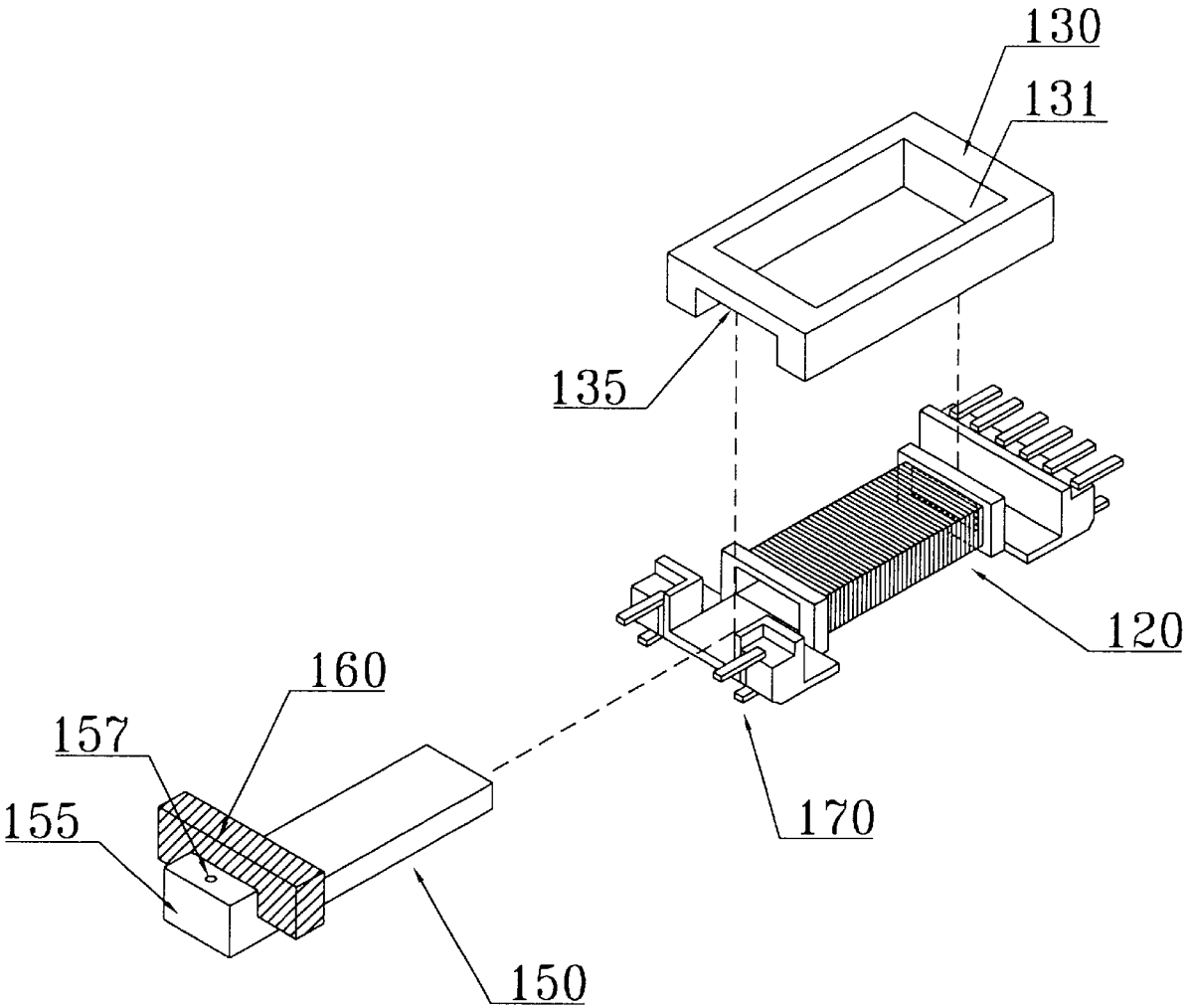
FIG. 2*b* is an exploded diagram showing a preferred embodiment of a method for manufacturing and assembling the inductor of the present invention.

One preferred embodiment of the inductor of the present invention is shown in FIG. 2*a*. Referring to FIGS. 2*a* and 2*b*, the inductor 100 at least includes a bobbin 120, a first magnetic member 130, and a second magnetic member 150. The bobbin 20 is wound by at least one round of wire which serves as a coil of the inductor 100. The first magnetic member 130 is engaged with the bobbin 120. The first magnetic member 130 has a concavity 135 on one side wall thereof for exposing the opening of the central hole of the bobbin 120. The first magnetic member 130 and the second magnetic member 150 are employed as a magnetic core of the inductor 100. The first and second magnetic members can be made of a soft magnetic material such as Mn—Zn ferrite, Ni—Zn ferrite or silicon steel plate. Preferably, the first and second magnetic members are crosssectionally U- and I-shaped magnetic core members, respectively.

The second magnetic member 150 has a first end and a second end. The first end of the second magnetic member 150 has a protrusion 155, the height of which is high enough to prevent the second magnetic member 150 from being completely inserted into the bobbin 120, that is, the protrusion 155 is stopped by the side wall of the first magnetic member with the concavity 135. The second magnetic member 150 can be inserted into the bobbin 120 from the second end thereof through the concavity 135 of the first magnetic member 130.

When adjusting the inductance of the inductor 100, a reference piece 160 with a suitable thickness is disposed between the protrusion 155 of the second magnetic member 150 and the side wall of the first magnetic member 130 with the concavity 135 and closely attached to both of them so as to form a gap between the second end of the second magnetic member 150 and a side wall of the first magnetic member 130 opposed to that of the first magnetic member 130 with the concavity 135. Thereafter, as a predetermined inductance is obtained, the thickness of the reference piece is measured. The second magnetic member 150 is shortened from the second end thereof according to the thickness of the reference piece 160 so as to form the gap after the shortened second magnetic member 150 is inserted into the bobbin 120. The second magnetic member 150 can be shortened by any prior technique including but not limited to the polishing method.

It should be noted that the reference piece 160 is not the component of the inductor of the present invention but only used to measure the truncated length of the second magnetic member 150. Therefore, it must be easily replaced and does not have the adhesive property. Its height must be greater than that of the side wall of the first magnetic member 130 with the concavity 135. Its shape is not limited and any object with some degree of thickness can be adopted, for example, rectangle (as shown in FIG. 2*b*) or cylinder (as shown in FIG. 2*c*).

Due to the presence of the protrusion 155, the shortened second magnetic member 150 is partially inserted into the bobbin 120. After the shortened second magnetic member 150 is inserted into the bobbin 120, the protrusion 155 will be stopped by the side wall of the first magnetic member 130 with the concavity 135, thereby easily positioning the bobbin 120, the first magnetic member 130, and the second magnetic member 150. In other words, the shortened second magnetic member 150 is pushed into the bobbin 120 until the protrusion 155 is stopped by the side wall of the first magnetic member 130 so as to precisely form the gap. Therefore, it is unnecessary to accurately calculate the length of the second magnetic member 150 inserted into the bobbin 120 like the prior art (or calculate the length of the second magnetic member 150 left out of the bobbin 120) or precisely fix the second magnetic member 150 relative to the first magnetic member 130. If the measured or judged inductance of the inductor does not meet the requirement, the thickness of the reference piece 160 can be increased or decreased or the reference piece 160 is replaced by another one with a more suitable thickness so as to obtain a predetermined inductance value.

Specially, there is a recess 157 formed on the upper surface of the protrusion 155 for allowing a suitable tool to be inserted therein in order to grab the second magnetic member 150 as shown in FIGS. 2*a*–2*c*. The recess includes but is not limited to a hole 157 for inserting a needle therein. Therefore, the second magnetic member 150 of the inductor of the present invention can be grabbed by a clip with the needle, which is convenient for the manufacturing process. Certainly, the recess can also have other shapes such as cross, etc.

Figure 3:
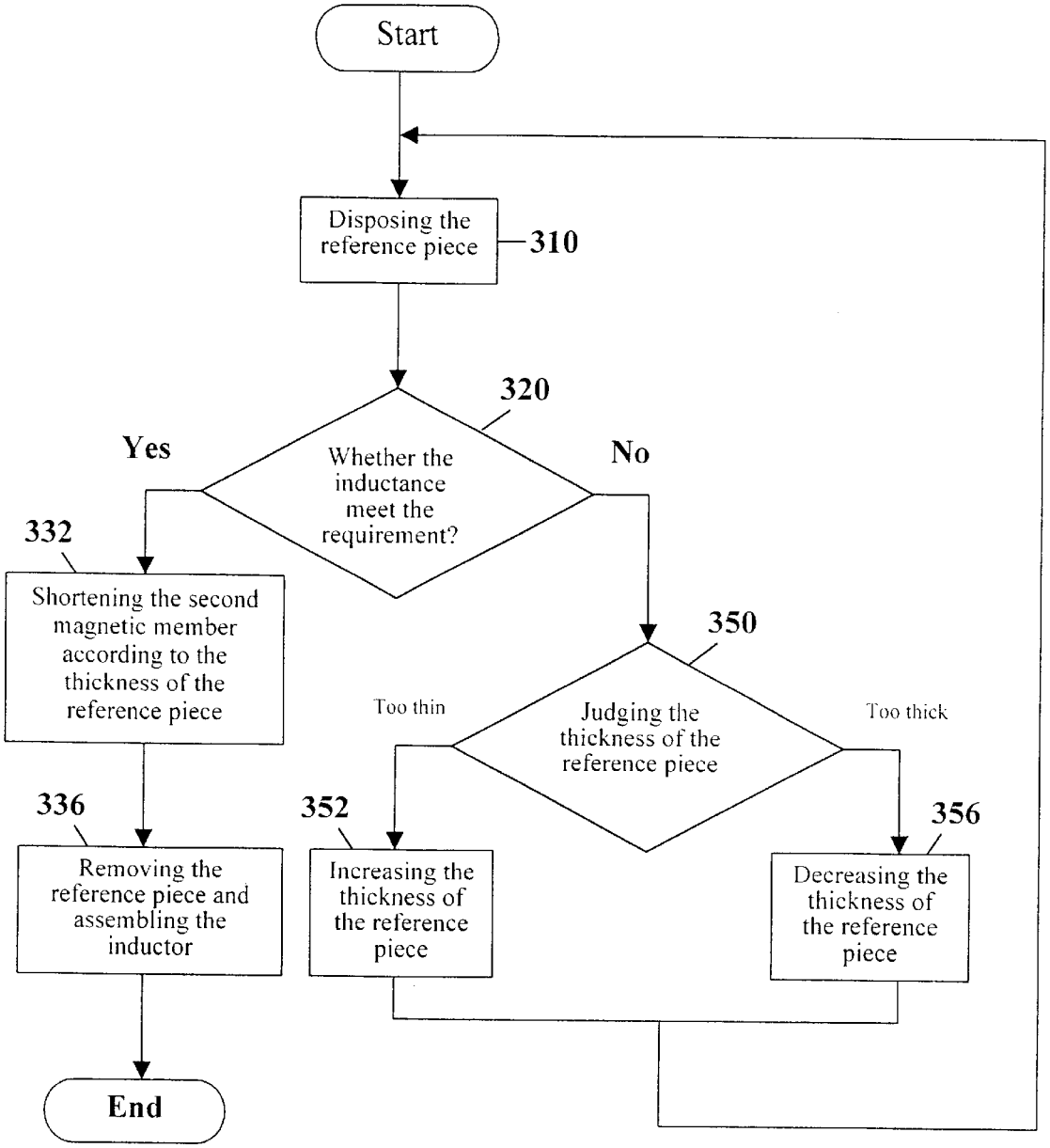
FIG. 3 is a flow chart showing the method of the present invention.

Now, please refer to FIG. 3 which is a flow chart showing the method of the present invention. At step 310, the reference piece 160 is disposed between the protrusion 155 of the second magnetic member 150 and the side wall of the first magnetic member 130 with the concavity 135 and closely attached to both of them when the second magnetic member 150 is inserted into the bobbin 120 so as to form a gap between the second end of the second magnetic member 150 and the side wall 131 of the first magnetic member 130. Thereafter, the process goes to step 320 to Judge whether the inductance of the inductor is identical to the desired value. If yes, the process goes to step 332 to shorten the second magnetic member 150 from the second end thereof according to the thickness of the reference piece 160. Certainly, any well-known method can be applied to the partial removal of the second magnetic member 150, including the polishing method. After partially removing the second magnetic member 150, the process goes to step 336 to remove the reference piece 160 and assemble the inductor. The second magnetic member 150 is continuously pushed into the bobbin 120 until the protrusion 155 is stopped by the side wall of the first magnetic member 130 with the concavity 135. Other subsequent steps are the same as the prior art and thus the detailed descriptions are omitted.

Please refer to FIGS. 2*b* and 3 again. If the measured or judged inductance of the inductor does not meet the requirement, the process goes to step 350 to judge whether the thickness of the reference piece 160 is too thick or too thin. If too thin, the process goes to step 352 to increase the thickness of the reference piece (adding another reference piece thereto or replacing it by another one with a thicker thickness) and the adjusting process is repeated again from step 310. On the contrary, if too thick, the process goes to step 356 to decrease the thickness of the reference piece or replace it by another one with a thinner thickness. Thereafter, the reference piece with a decreased thickness is put between the protrusion 155 and the side wall of the first magnetic member 130 with the concavity 135 and closely attached to both of them to repeat the adjusting process again.

In conclusion, the characteristic of the method of the present invention can solve the problems encountered by the conventional inductor. First of all, because the inductor of the present invention does not need the gap spacer, some defects caused by the spacer can be eliminated, for instance, the problems caused by the adherence between the spacer and the inner wall of the central hole of the bobbin, the thermal expansion of the spacer, or the portion of the second magnetic member 150 protruded over the edge of the pin of the bobbin. In addition, because the second magnetic member 150 has a protrusion 155, it is easy to control the length of the second magnetic member 150 inserted into the bobbin 120. Furthermore, the reference piece 160 can be used repeatedly and its shape is not limited, thereby simplying the manufacturing process. Moreover, the protrusion 155 has a recess for allowing users to insert a tool therein to grab the second magnetic member 150 conveniently.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A method for adjusting the inductance of an inductor including a bobbin having at least one round of wire wound thereon, a first magnetic member having a concavity on a side wall thereof, and a second magnetic member having a protrusion at a first end thereof for allowing said second magnetic member to be partially inserted into said bobbin, comprising the steps of:

(a) selecting a reference piece with a suitable thickness to be disposed between said protrusion of said second magnetic member and said side wall of said first magnetic member and closely attached to said protrusion of said second magnetic member and said side wall of said first magnetic member as said second magnetic member is inserted into said bobbin;

(b) determining whether the inductance of said inductor is identical to a predetermined value; and (c) partially removing said second magnetic member from a second end thereof in accordance with said thickness of said reference piece if the inductance of said inductor is identical to said predetermined value; otherwise said steps (a) to (c) being repeated until said predetermined inductance value is obtained.

2. The method according to claim 1 wherein said first magnetic member is a U-shaped type magnetic core member and said second magnetic member is an I-shaped type magnetic core member.

3. The method according to claim 1 wherein said first and second magnetic members are made of one selected from a relatively soft magnetic material, Mn—Zn ferrite, Ni—Zn ferrite and a silicon steel plate, respectively, and employed as a magnetic core of said inductor.

4. The method according to claim 1 wherein said second magnetic member is shortened by polishing said second end thereof.

5. The method according to claim 1 wherein a height of said reference piece is greater than that of said side wall of said first magnetic member with said concavity.

6. The method according to claim 1 wherein said reference piece is used for forming a gap between said second end of said second magnetic member and an another side wall of said first magnetic member opposed to said side wall of said first magnetic member with said concavity.

7. The method according to claim 1 wherein said reference piece is removed before said inductor is assembled.

8. The method according to claim 1 wherein said protrusion of said second magnetic member has a recess formed on an upper surface thereof for inserting a tool therein to grab said second magnetic member.

9. A method for adjusting the inductance of an inductor including a bobbin having at least one round of wire wound thereon, a first magnetic member having a concavity on a side wall thereof, and a second magnetic member having a protrusion at a first end thereof for allowing said second magnetic member to be partially inserted into said bobbin, comprising the steps of:

selecting a reference piece with a suitable thickness to be disposed between said protrusion of said second magnetic member and said side wall of said first magnetic member and closely attached to said protrusion of said second magnetic member and said side wall of said first magnetic member with said concavity as said second magnetic member is inserted into said bobbin; and partially removing said second magnetic member from a second end thereof according to said thickness of said reference piece so as to obtain a predetermined inductance value.

10. The method according to claim 9 further comprising a step of determining whether the inductance of said inductor is identical to said predetermined inductance value after said reference piece is disposed between said protrusion of said second magnetic member and said side wall of said first magnetic member and said second magnetic member is partially inserted into said bobbin.

11. The method according to claim 10 wherein said thickness of said reference piece is changed if the inductance of said inductor is not identical to said predetermined inductance value.

12. The method according to claim 9 wherein said first magnetic member is a U-shaped type magnetic core member and said second magnetic member is an I-shaped type magnetic core member.

13. The method according to claim 9 wherein said first and second magnetic members are made of one selected from a relatively soft magnetic material, Mn—Zn ferrite, Ni—Zn ferrite and a silicon steel plate, respectively, and employed as a magnetic core of said inductor.

14. The method according to claim 9 wherein said second magnetic member is shortened by polishing said second end thereof.

15. The method according to claim 9 wherein a height of said reference piece is greater than that of said side wall of said first magnetic member with said concavity.

16. The method according to claim 9 wherein said reference piece is used for forming a gap between said second end of said second magnetic member and an another side wall of said first magnetic member opposed to said side wall of said first magnetic member with said concavity.

17. The method according to claim 9 wherein said reference piece is removed before said inductor is assembled.

18. The method according to claim 9 wherein said protrusion of said second magnetic member has a recess formed on an upper surface thereof for inserting a tool therein to grab said second magnetic member.

* * * * *